US005103137A

United States Patent [19]

Blake et al.

[11] Patent Number: 5,103,137

[45] Date of Patent: Apr. 7, 1992

[54] ANTI-CYCLING DEVICE FOR HIGH PRESSURE SODIUM LAMPS

[75] Inventors: Frederick H. Blake, Mill Creek; C. David Long, Redmond; Arthur G. Collin, Seattle, all of Wash.

[73] Assignee: Multipoint Control Systems, Inc., Everett, Wash.

[21] Appl. No.: 503,394

[22] Filed: Apr. 2, 1990

[51] Int. Cl.[5] ..... H05B 37/00

[52] U.S. Cl. ..... 315/119; 315/290

[58] Field of Search ..... 315/119, 127, 289, 290, 315/360, DIG. 2

[56] References Cited

U.S. PATENT DOCUMENTS

| | | | |
|---|---|---|---|
| 3,631,441 | 12/1971 | Murphy | 315/136 |
| 3,995,262 | 11/1976 | France | 315/129 |
| 4,207,500 | 6/1980 | Duve et al. | 315/119 |
| 4,473,779 | 9/1984 | Lindner et al. | 315/119 |
| 4,745,339 | 5/1988 | Izawa | 315/129 |
| 4,810,936 | 3/1989 | Nuckolls et al. | 315/119 |
| 4,853,599 | 8/1989 | Singarayer | 315/119 |
| 4,949,018 | 8/1990 | Siglock | 315/119 |

*Primary Examiner*—Eugene R. Laroche
*Assistant Examiner*—Amir Zarabian
*Attorney, Agent, or Firm*—Bruce A. Kaser

[57] ABSTRACT

The invention disclosed here is an anti-cycling device for high-pressure sodium lamps. A current sensor continually monitors lamp current and outputs a low voltage signal to an amplifier. When lamp current increases, indicating a starting or recycling condition, the sensor's voltage output correspondingly increases, and the amplifier responds by amplifying such output and transmitting it to a second amplifier. The latter acts as a voltage comparator and compares the first amplifier's output with a threshold level. Each time the first amplifier's output exceeds the threshold, the second amplifier outputs a trigger signal. Such signal is counted over time, and if the number of counts reaches a certain number, the counter outputs a malfunction signal to a relay that cuts off power to the lamp. An easy-to-see LED simultaneously illuminates to indicate the cycling condition and the need for lamp maintenance.

6 Claims, 5 Drawing Sheets

ANTI-CYCLING DEVICE FOR HIGH PRESSURE SODIUM LAMPS

TECHNICAL FIELD

The invention disclosed here generally relates to electrical controls, and more particularly, to street lamps or luminaires whose power is automatically supplied and cut-off at dusk and dawn, respectively

BACKGROUND INFORMATION

High-pressure sodium lamps are well-known in the lighting field, and are currently in wide use by many city utilities for street lighting purposes. As a person skilled in the art would know, although such lamps have a long lifespan, they eventually fail over time because their sodium becomes depleted to a point where lamp voltage can no longer maintain a continuous arc. The result is a cycling condition where a depleted lamp continually flashes or attempts to start. Not only is this a difficult condition to detect and correct both quickly and cost-effectively, but it is also annoying, especially in residential areas where it can be visually distracting and/or cause radio and television interference.

FIG. 6 herein, which is labeled "prior art", schematically illustrates the start-up operation of a typical high-pressure sodium lamp. Each lamp is normally powered by a line voltage of 120 volts AC, which is schematically indicated at 1, 3. A photocell sensor control 5, positioned in series between the power source and the lamp, is operative to supply power at dusk, and to cut off power at dawn.

In the evening, when the photosensor control 5 initially causes power to be supplied, the lamp is initially in an unlit condition. Such lamps have a ballast choke/-transformer 7 with a secondary winding or coil 9 that is connected to a pulsing starter device 11. When power is initially supplied, the starter device 11 sends pulses to the secondary coil 9. This causes the ballast 7 to act as a step-up transformer that generates high voltage spikes of several thousand volts across the lamp's electrodes 13, 15, and consequently results in ignition of the lamp. Once ignition occurs, current flow through the ballast causes the lamp voltage to drop (typically from about 150 to 55 volts AC), and pulsing from the starter device 11 ends. If the lamp cannot hold ignition because of sodium depletion, it will subsequently and repetitively attempt to restart as soon as it cools sufficiently so that sodium ionization can once again take place.

Obviously, cycling is correctable by simply replacing a depleted lamp. However, if a cycling condition is allowed to continue over a period of time, it eventually damages the lamp's starter/ballast unit 7, 11, typically by burning out the ballast 11. When this happens, the lamp ceases to cycle, but the starter/ballast unit must then be replaced along with the depleted lamp, resulting in higher overall costs of repair. For such reason, it is important to detect a cycling condition as soon as possible.

From the standpoint of labor, many or most city utilities have no cost-effective means for quickly detecting when such lamps are cycling. The typical utility does not have service people checking street lamps at night, which is the only time cycling is apparent since such lamps normally do not operate during the day.

Furthermore, cycling is difficult to detect even in situations where service checks are made at night. Depending on the level of sodium depletion, a cycling lamp often remains lit several minutes or more before it loses its arc and attempts to relight. This requires a service person to visually monitor individual lamps for more than just a brief period of time in order to discover whether cycling is occurring.

Since high-pressure sodium lamps have a predicted service life, most city utilities have simply taken to automatically replacing groups of lamps at selected times after they have been placed in service, regardless of whether or not a significant number of such lamps have actually begun to cycle. This is inefficient because it too often results in an earlier than necessary lamp replacement, or replacement after many lamp ballasts have already burned out, and consequently, does not make optimum use of each lamp.

Historically, high-pressure sodium lamps went into large-scale result of the energy shortages created by an Arab oil embargo in or about that time. High-pressure sodium lamps have approximately twice the energy efficiency of their predecessors, mercury vapor lamps, which were the most common street lamps in use before that time. The sodium lamps put into service in the mid-70's are now reaching the end of their design life. This means that the above-described cycling problem is becoming pressing, and must be quickly solved in a way that will maximize the life of existing lamps in an easy-to-implement, cost-effective manner.

The patent literature discloses that few inventors or compares have yet had occasion to address the above problem. One notable exception involves the efforts of Area Lighting Research, a Hackettstown, N.J. company. Area Lighting is the assignee of two U.S. patents, one issued on June 10, 1980 to Duve et al. (U.S. Pat. No. 4,207,500), and the other issued on Sept. 25, 1984 to Lindner et al. (U.S. Pat. No. 4,473,779). Both patents specifically relate to the cycling malfunction of depleted high-pressure sodium lamps, and each offers a solution, albeit one that is different from the invention disclosed here. It should be mentioned in passing that both patents provide a much more detailed description of the cause of the cycling malfunction than the cursory explanation provided above. Accordingly, their disclosures are incorporated herein by reference.

Duve et al. discloses a cut-off device that activates a relay in response to a signal from a detector-signal generator that senses when the voltage increase across the lamp is greater in magnitude than the lamp's normal operating voltage. The increase in voltage corresponds to the lamp's attempt to relight itself. A timing circuit monitors the signal from the detector-signal generator, and determines whether the sensed increase in voltage constitutes undesirable cycling. If so, the timing circuit activates the relay, thus cutting off power to the lamp.

Lindner et al. claims to be an improvement over Duve, and determines cycling by sensing a change in lamp power factor. In doing so, Lindner uses the combination of both a voltage signal generator and a current signal generator which simultaneously transmit their signals to a comparator-processor, where the latter compares their phases. When their phases have a certain known relationship that corresponds to cycling, Lindner similarly activates a relay cutting off power to the lamp.

As will become apparent, the present invention provides an anti-cycling device that is simpler in both design and operation than either one of the two devices discussed above. Further, the device disclosed here is low in cost, extremely reliable, and is equally well-suited for either retrofitting to street lamps presently in use, or factory installation by the lamp manufacturer.

SUMMARY OF THE INVENTION

The invention is an anti-cycling device or installation that cuts off power to a high-pressure sodium lamp in the event such lamp is cycling as a result of sodium depletion. The invention accomplishes this through a unique combination of amplifiers that output a countable triggering signal in response to the increased current drawn by the lamp as a result of its attempt to restart or relight.

As was previously described, conventional sodium lamps are typically photocell controlled when used in conjunction with street light installations. In other words, a photocell, or in some cases, a timeclock, either enables power supply to the lamp, or cuts it off, depending on whether it is night or day. Power is typically supplied to the lamp by a pair of conventional electrically conductive wires or leads, and the photocell control is positioned in series in one of such leads.

The anti-cycling device has a current sensor connected in series to one lead between the photocell control and the lamp. Such sensor is operative to develop or output a continuous AC voltage signal that is generally proportional to the magnitude of the alternating current in the lead as current passes through the lamp. An extinguished lamp that either initially starts in the beginning of an evening, or attempts to restart as a result of cycling, draws higher than normal current levels. This, in turn, creates a higher than normal alternating voltage output from the sensor.

A first one of the previously-mentioned amplifiers is responsively connected to the current sensor in a manner so that it continuously senses the sensor's voltage output, and generates an amplified AC voltage output signal whose magnitude is also generally proportional to the sensor voltage. This output is rectified by a set-point diode, and is transmitted to another amplifier. The second amplifier receives such signal and compares its magnitude to the level of a certain preselected threshold signal. The latter amplifier, in response to the first amplifier's output, is operative to output a trigger signal transmission every time the first amplifier's rectified output exceeds the threshold level.

A counter receives and counts each trigger signal transmitted from the second amplifier. It is programmed to output a malfunction or cut-off signal in the event it counts a certain preselected number of trigger signal transmissions (preferably three) during a given time period. Such signal activates a relay, thus cutting off power to the lamp until the counter is reset.

The counter's malfunction signal also causes an LED to be illuminated. Such LED is positioned so that it is visible during daylight hours to a maintenance person, for informing such person that the lamp is cycling and needs to be replaced.

The anti-cycling device also has reset circuitry that resets the counter either when power is initially supplied from the photocell control to the lamp (at the beginning of each evening), or in any other situation where lamp power is suddenly turned completely off and then on again. Thus, a malfunctioning lamp cycles for only a set number of times during any given night, and then shuts down until the next night. This eliminates the on-going cycling which occurs in malfunctioning lamps, which typically goes undetected until the lamp's starter/ballast unit burns out.

The invention will become better understood upon consideration of the following description, which is intended to be taken in conjunction with the attached drawings.

BRIEF DESCRIPTION OF THE DRAWINGS

In the drawings, like reference numerals and letters indicate like parts throughout the various views, unless indicated otherwise, and wherein.

BEST MODE FOR CARRYING OUT THE INVENTION

Figure 1:
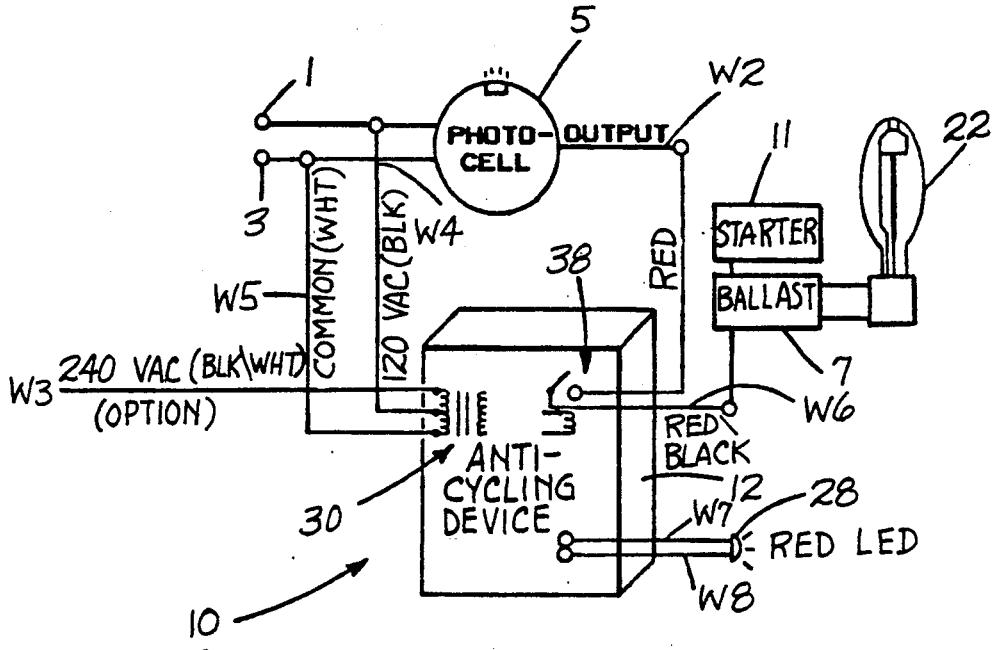
FIG. 1 is a schematic view of an anti-cycling device in accordance with a preferred embodiment of the invention, and shows its physical relationship relative to a high-pressure sodium lamp and a photocell control for such lamp.

Referring now to the drawings, and first to FIG. 1, indicated generally at 10 is an anti-cycling device constructed in accordance with a preferred embodiment of the invention. Briefly, and as will be further described, the device's electrical circuitry is shown in FIG. 5. As a person of ordinary skill would know, such circuitry would be implemented via a conventional printed circuit card installation. Such card is not shown in the drawings, however, because it is unnecessary in order to enable the skilled person to practice the invention. Preferably, it is received in a suitable weatherproof housing, such as the rectangularly-shaped housing 12 shown in FIGS. 1 and 4.

Figure 4:
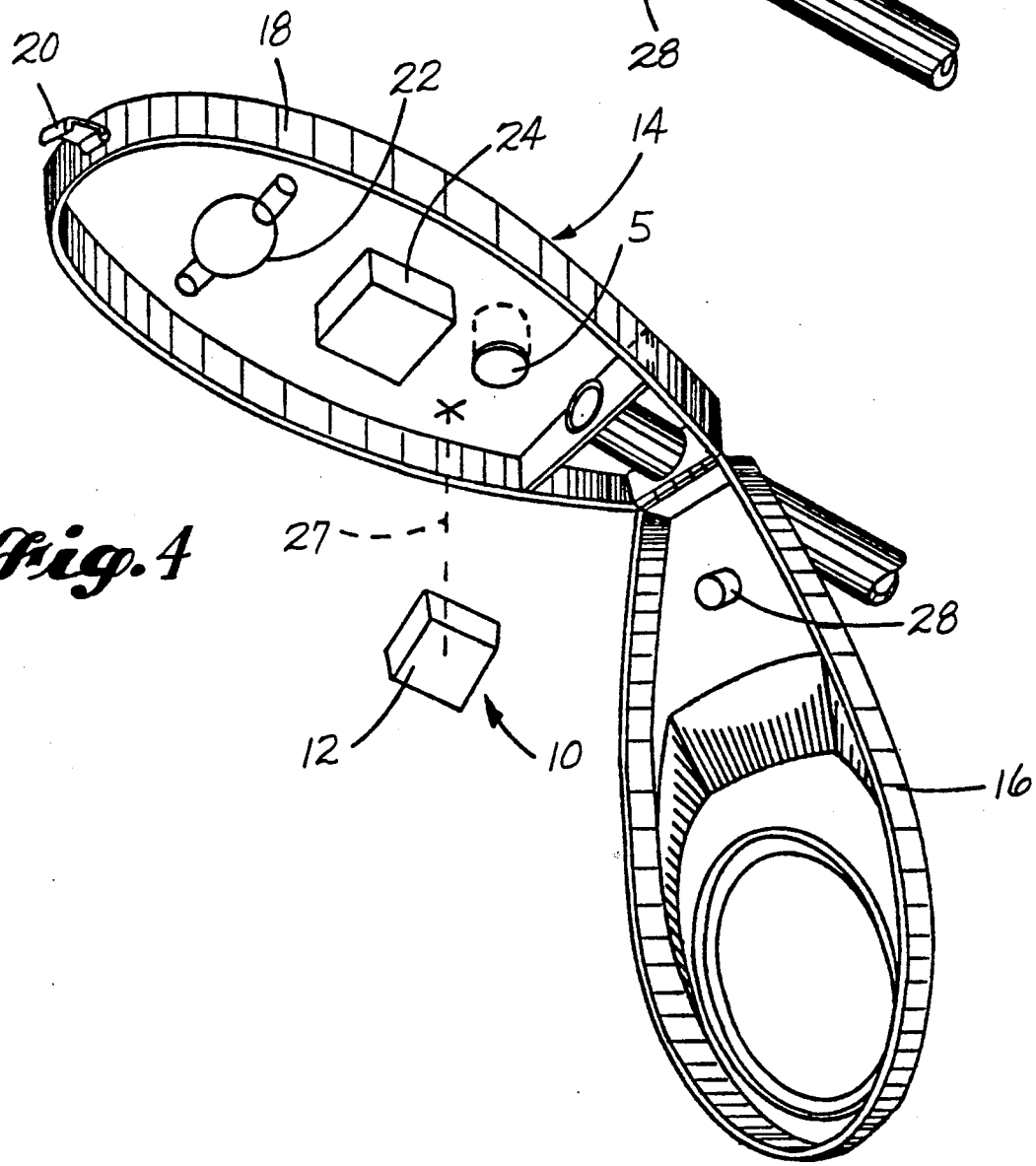
FIG. 4 is a view like FIG. 3, but shows the lamp's housing in an open condition for installing the anti-cycling device of FIG. 1.
Figure 5:
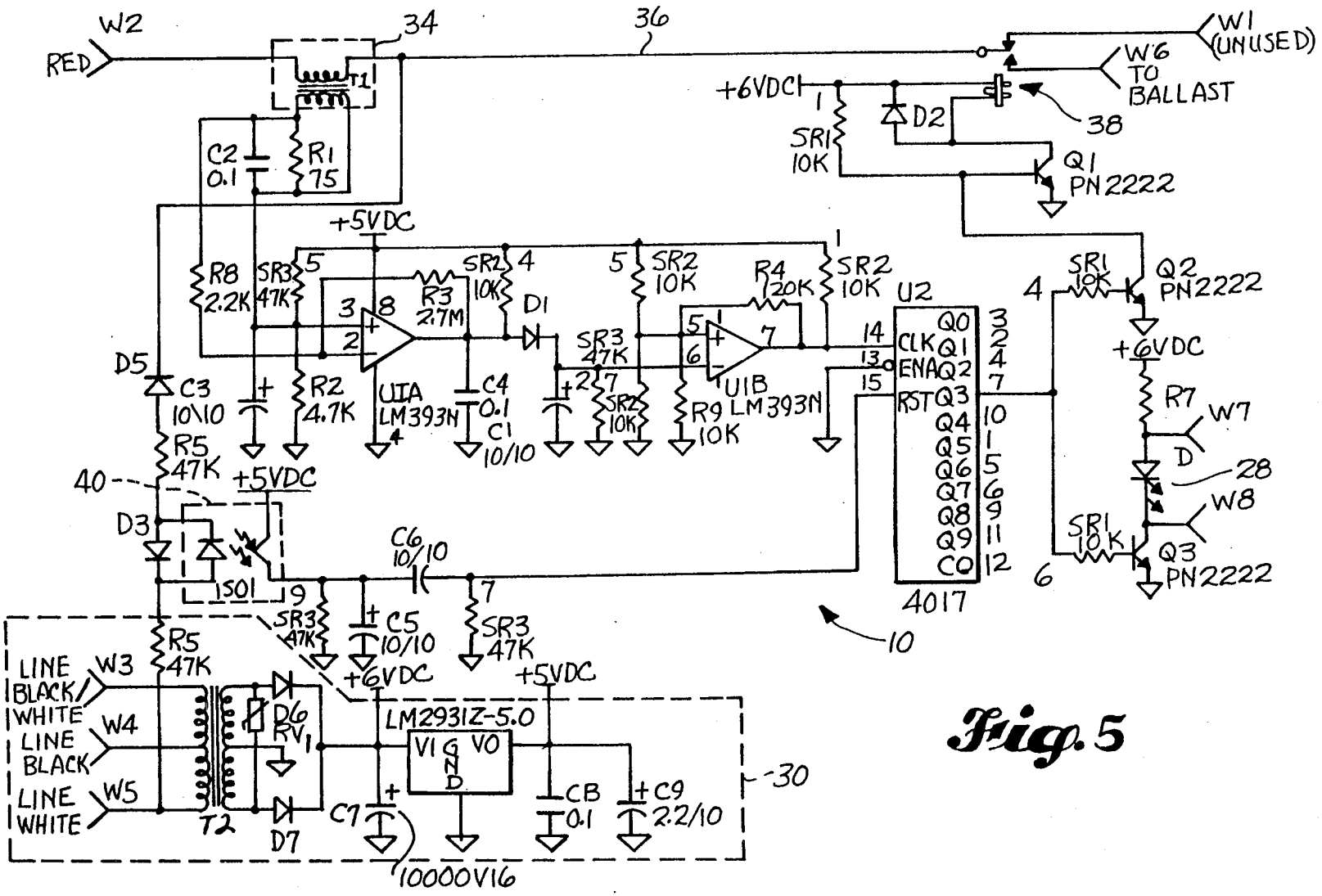
FIG. 5 is an electrical schematic of the anti-cycling device of FIG. 1.

Referring now to FIG. 4, the anti-cycling device 10 is well-suited for retrofitting inside an existing street light housing 14. Typically, the lower half 16 of such housing is hinged at one end to its upper half 18. A conventional off-center clip 20 normally holds the two halves 16, 18 together at the other end. Received within the housing is the sodium lamp 22, a starter/ballast unit 24, which includes the previously-described starter device 11 and ballast 7, and the photocell sensor control 5. The photocell sensor 5 typically receives ambient lighting from above housing 14.

The housing 14 has plenty of space for receiving the anticycling device's housing 12. Such housing 12 is preferably mounted therein by an adhesive or mounting brackets, or other suitable means, at any unoccupied location that is not too close to the lamp. Dashed line 27 indicates one possible location, although others are equally suitable.

Preferably, the device 10 has a red LED 28 that functions as an indicator light. This light 28 is positioned so that it Reference numeral 28' in FIG. 4 illustrates one possible location where LED 28 may be conveniently mounted through the housing's lower half 16 so that it is easy to see.

Figure 2:
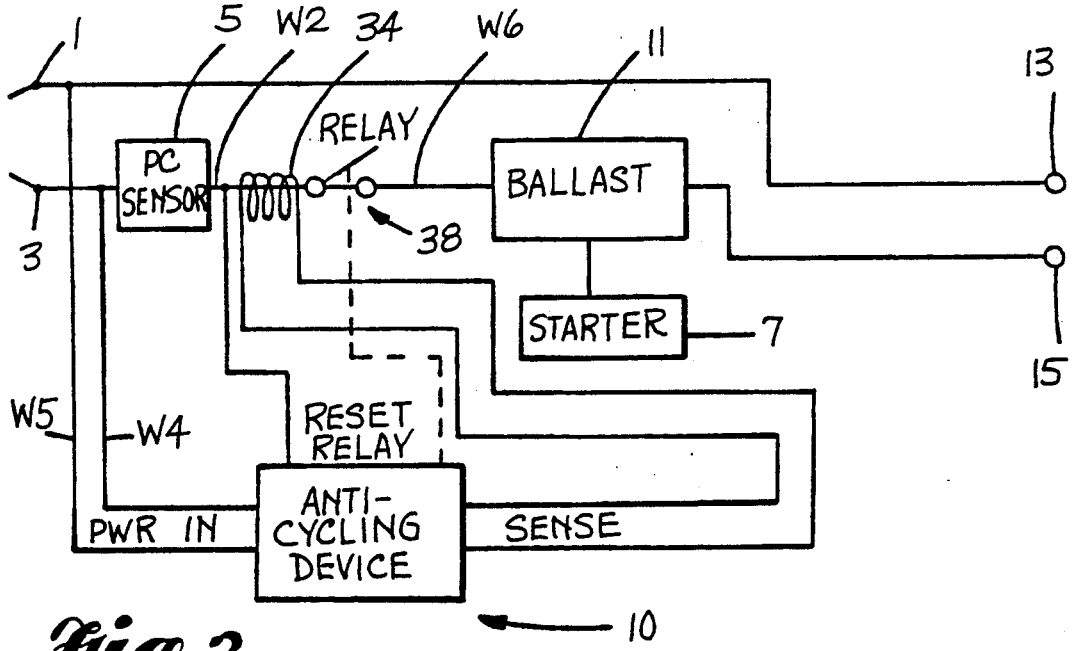
FIG. 2 is a schematic-block diagram showing how the anti-cycling device of FIG. 1 is implemented relative to existing lamp components.
Figure 3:
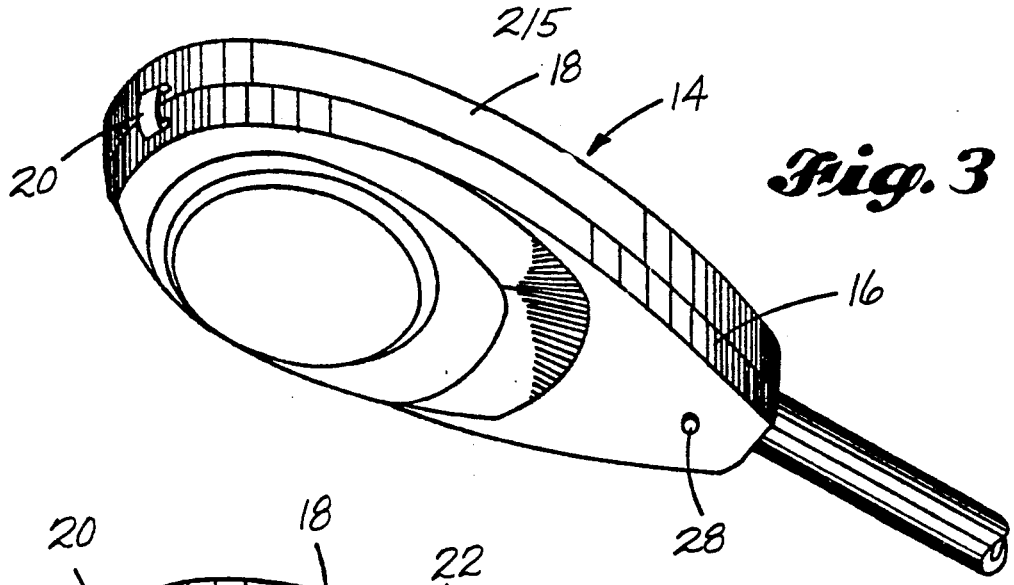
FIG. 3 is a pictorial view of the head of a conventional street light that utilizes a high-pressure sodium lamp.

As is apparent, the electrical interconnections between the components 5, 10, 22, 24, 28 in the housing 14 are not shown in FIG. 4. These are schematically illustrated in FIGS. 1 and 2, however, and FIG. 5 provides a complete electrical schematic of the anti-cycling device itself.

Regarding the latter, conventional patent application reference numerals will be dispensed with, except where specifically indicated in certain portions of the following text. As mentioned above, the FIG. 5 circuitry would normally reside on a printed circuit card. Lead W2 in FIGS. 1, 2 and 5 indicates the anti-cycling device's connection to the lamp's power supply downstream of any power control by photocell 5. Lead W6 indicates where the device 10 connects to the lamp ballast 7. W4 and W5 indicate lead connections to a conventional 120 volt AC power source, for the purpose of supplying operating power to the device 10, and W3 is an optional lead for providing 240 volts AC to the device 10. Lead W1 is currently unused.

In order to completely understand the invention, it will not be necessary here to identify each and every electrical resistor, capacitor, diode, etc. shown in the various drawings. The purpose and function of such elements would, for the most part, be self-evident to the skilled person having the FIG. 5 schematic alone without further explanation. For this reason, only the important features of the FIG. 5 circuitry will be described here, followed by a table (Table I) listing the specific part numbers and values as shown in the FIG.

Block 30 at the bottom of FIG. 5 indicates the power supply for the device 10. This transforms conventional 120 volt AC power to 6 and 5 volts DC, the latter being used to power other parts of the device 10. Of significance is a low voltage regulator 32 that significantly reduces power dissipation and the heating problems associated with power supply.

Block 34 identifies a current transformer that senses current levels in the wire lead 36 that supplies power to the lamp ballast (indicated at W6). This transformer is of a type that can generally measure current from 1 to 10 amps RMS, and outputs a low voltage signal that is sensed by a first amplifier U1A.

Such amplifier U1A amplifies the transformer's output to a level where it can be detected as a lamp cycling malfunction. It's output is transmitted through a set-point diode D1 to one side of a second amplifier U1B which operates as a voltage comparator. Pin 5 of amplifier U1B sets a certain threshold value, causing the amplifier to output a trigger signal as the voltage at pin 6 goes up or down relative to the threshold value. The set-point diode D1 functions as a rectifying diode since the first amp U1A outputs an amplified alternating signal in response to the alternating voltage output of transformer 34.

The output of the second amplifier U1B is transmitted to and drives a counter U2, the latter outputting a malfunction signal at pin 7 if the counter receives three trigger signals from amplifier U1B. It should be mentioned at this point that the type of counter identified in FIG. 5 could be set or programmed to count up to nine trigger signals, if desired, at the option of the user. The counter's output further triggers a network including three transistors Q1, Q2, Q3 which, in turn, illuminate indicator light LED 28, and activate a relay switch 38 that cuts off power to the ballast 11.

The counter U2 is reset by a photodiode-isolated transistor 40. This unit provides a reset signal to counter U2 every time that line power is turned off, and then back on again, or if the photocell 5 calls for power to be supplied at the beginning of each night. Either situation creates a reset signal from unit 40, meaning that counter U2 is reset every night for another three tries at lighting the lamp.

Figures 6, 7:
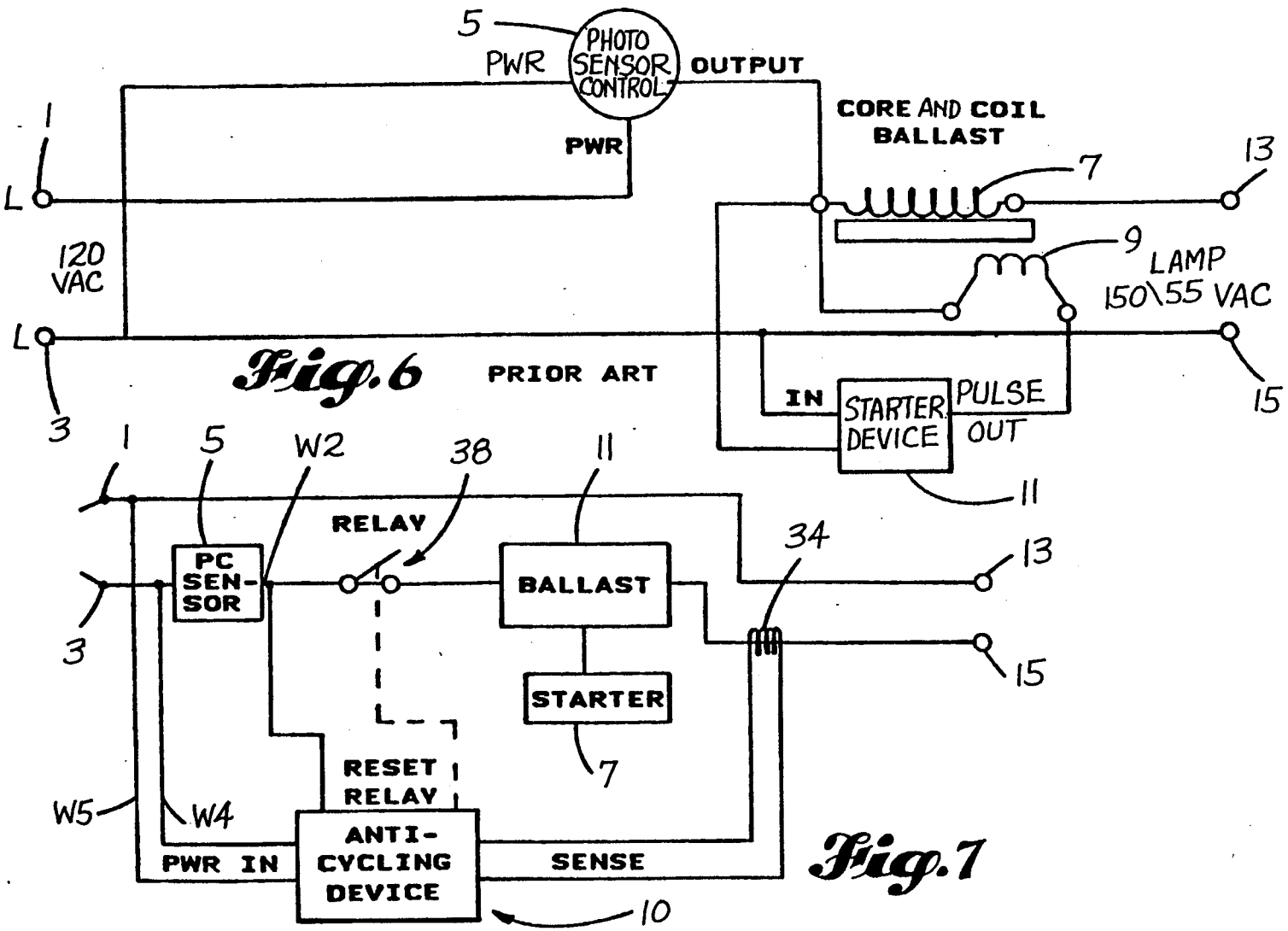
FIG. 6 is a schematic-block diagram similar to FIG. 2, and is labeled "prior art", and shows the components of a typical high-pressure sodium lamp without an anti-cycling device installed.
FIG. 7 is a view like FIG. 2, but shows an alternative embodiment of the anti-cycling device disclosed here for use in connection with a constant power ballast.
Figure 8:
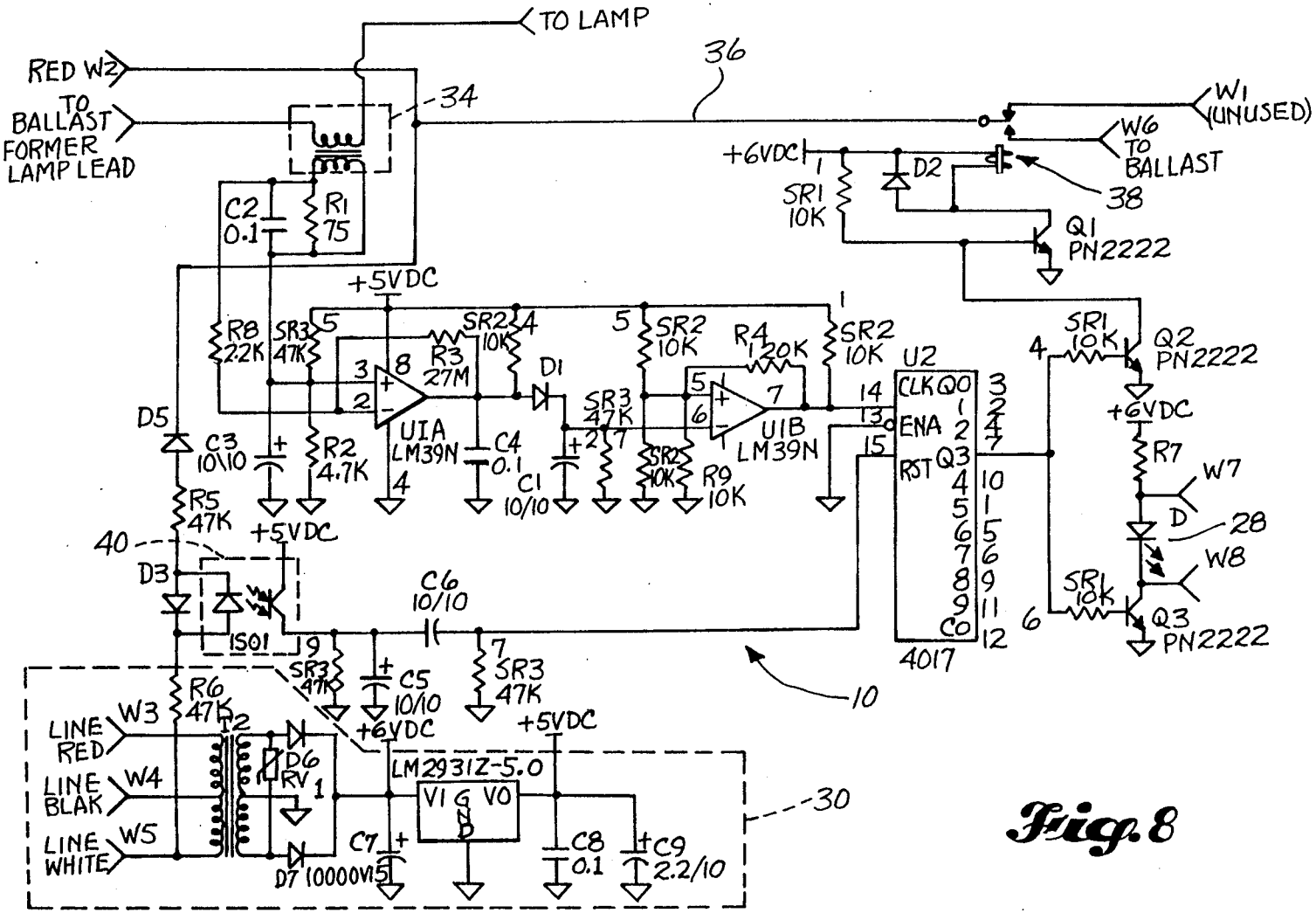
FIG. 8 is an electrical schematic for the embodiment of the anti-cycling device shown in FIG. 7.

FIGS. 7 and 8 illustrate an alternative embodiment of an anti-cycling device in accordance with the invention. The embodiment shown there is intended to be used in connection with constant power ballasts, or where the load is not directly connected to the input power for the device. Referring first to FIG. 7, for example, there it is shown that the current sensor 34 is positioned in between ballast and lamp electrode 15. FIG. 8, which for the most part is similar to FIG. 5, shows the various required lead connections W2, W3, W4, W6 for this embodiment as illustrated in FIG. 7. In all other respects, the FIG. 8 device works exactly the same as the FIG. 5 device.

TABLE I

| Element | Component Value and/or Part No. |
|---|---|
| C1 | 10 microfarad/10 volt |
| C2 | 0.1 microfarad |
| C3 | 10 microfarad/10 volt |
| C4 | 0.1 microfarad |
| C5 | 10 microfarad/10 volt |
| C6 | 10 microfarad/10 volt |
| C7 | 100V16 |
| C8 | 0.1 microfarad |
| C9 | 2.2 microfarad/10 volt |
| SR1 | 10 K ohms |
| SR2 | 10 K ohms |
| SR3 | 47 K ohms |
| R1 | 75 K ohms |
| R2 | 4.7 K ohms |
| R3 | 2.7 M ohms |
| R4 | 120 K ohms |
| R5 | 47 K ohms |
| R6 | 47 K ohms |
| R7 | .27 K ohms |
| R8 | 2.2 K ohms |
| R9 | 10 K ohms |
| D1-D7 | 1.0 amp, 600 volt. rect. diode |
| Q1-Q3 | PN2222 |
| U2 | 4017 |
| U1A | LM393N |
| U1B | LM393N |
| T1 | 50/60 L/Z CS60-010 Current Sensor |
| T2 | AC/DC transformer (input 115/230 V 50/60 Hz; output 10 V @ 0.25A or 5 V @ 0.5A) |
| Ref. Num 32 | LM2931Z-5.0 |

Having thus described the best mode presently known for implementing an anti-cycling device in accordance with the invention, it is to be understood that certain changes could be made to the device disclosed here without departing from what is considered to be the scope of the patentable invention. The preceding description is not to be taken in the limiting sense, but instead is to be taken and read for the purpose of interpreting the claimed invention as set forth in the patent claims which follow. Such claims, and only such claims, when interpreted in accordance with well-established doctrines of patent claim interpretation, define the metes and bounds of the invention described here.

What is claimed is:

1. An anti-cycling device, for cutting off the electrical power supplied to a malfunctioning high-pressure sodium lamp, and the like, wherein electrical power is supplied from a power source to said lamp by at least a pair of electrically conductive power supply wires, said device comprising:

a current transformer, operatively connectable to at least one of said wires, said current transformer being characterized in that when it is operatively connected to said at least one wire, said current transformer develops an alternating low voltage output that varies generally proportionally to variations in the magnitude of the electric current in said at least one wire;

a first operational amplifier responsively connected to said current transformer, and characterized in that said first amplifier outputs an amplified alternating voltage output signal whose magnitude is generally proportional to said voltage output of said current transformer;

a second operational amplifier;

a set-point diode interconnecting said first and second operational amplifiers, said set-point diode rectifying said first amplifier's alternating voltage output signal, and transmitting said rectified output signal to said second operational amplifier, wherein said second amplifier is characterized in that it is operative to compare said rectified signal with a certain preselected threshold signal, and to transmit a trigger signal every time said rectified signal exceeds said threshold signal;

a counter, operatively connected to said second amplifier for receiving each trigger signal from the same, said counter being characterized in that it counts the number of transmissions of said trigger signal from said second amplifier during a given time period, and outputs a malfunction cut-off signal in the event such number exceeds a certain preselected number during such period; and a switch, connectable to at least one of said power supply wires, and connected to said counter in a manner such that said switch is operable to disconnect said lamp from said power source in response to the output of said malfunction cut-off signal from said counter.

2. The anti-cycling device of claim 1, including an indicator light connected to said counter in a manner such that said light obtains an activated condition in response to the output of said malfunction cut-off signal from said counter, said indicator light being positionable in a location relative to said high-pressure sodium lamp so as to be observable by a maintenance person.

3. The anti-cycling device of claim 1, including reset circuit means connected to said counter, for resetting the number of trigger signals counted by said counter to zero each day.

4. The anti-cycling device of claim 3, wherein said reset circuit means is further operable to reset the number of trigger signals counted by said counter to zero in response to electrical connection of said lamp to said power source.

5. The anti-cycling device of claim 1, including reset circuit means having a photodiode-isolated transistor, said photodiode-isolated transistor interconnecting said pair of electrically conductive power supply wires.

6. An anti-cycling device, for cutting off the electrical power supplied to a malfunctioning high-pressure sodium lamp, and the like, wherein electrical power is supplied from a power source to said lamp by at least a pair of electrically-conductive power supply wires, and a constant power ballast is serially positioned in one of said power supply wires, said device comprising:

a current transformer, operatively connected to said one power supply wire between said constant power ballast and said lamp, said current transformer being characterized in that when it is operatively connected to said one power supply wire, said current transformer develops an alternating low voltage output that varies generally proportionally to variations in the magnitude of the electric current in said wire;

a first operational amplifier responsively connected to said current transformer and characterized in that said first amplifier outputs an amplified alternating voltage output signal whose magnitude is generally proportional to said voltage output of said current transformer;

a second operational amplifier;

a set-point diode interconnecting said first and second operational amplifiers, said set-point diode rectifying said first amplifier's alternating voltage output signal, and transmitting said first amplifier's output signal to said second operational amplifier, wherein said second amplifier is characterized in that it is operative to compare said rectified signal with a certain preselected threshold signal, and to transmit a trigger signal every time said rectified signal exceeds said threshold signal;

a counter, operatively connected to said second amplifier for receiving each trigger signal from the same, said counter being characterized in that it counts the number of transmissions of said trigger signal from said second amplifier during a given time period, and outputs a malfunction cut-off signal in the event such number exceeds a certain preselected number during such period; and a switch, connectable to at least one of said power supply wires, and connected to said counter in a manner such that said switch is operable to disconnect said lamp from said power source in response to the output of said malfunction cut-off signal from said counter.

* * * * *

UNITED STATES PATENT AND TRADEMARK OFFICE

CERTIFICATE OF CORRECTION

PATENT NO. : 5,103,137

DATED : April 7, 1992

INVENTOR(S) : Frederick H. Blake, C. David Long and Arthur G. Collin

It is certified that error appears in the above-indentified patent and that said Letters Patent is hereby corrected as shown below:

Column 1, line 9, after "respectively", insert --.--.

Column 2, line 17, after "large-scale", insert

-- use as street lamps in or about the mid-70's, as a --

Column 2, line 29, "compares" should be -- companies --.

Column 5, line 5, after "that it", insert -- is visible from below housing 14 by a maintenance person. --.

Column 6, line 36, "C7 100V16" should be

-- C7 1000V16 --.

Signed and Sealed this

Twelfth Day of October, 1993

*Attest:*

*Attesting Officer*

BRUCE LEHMAN

*Commissioner of Patents and Trademarks*